US010851738B2

(12) United States Patent
Gukelberger et al.

(10) Patent No.: US 10,851,738 B2
(45) Date of Patent: Dec. 1, 2020

(54) INTERNAL COMBUSTION ENGINE HAVING DEDICATED EGR CYLINDER(S) AND IMPROVED FUEL PUMP SYSTEM

(71) Applicant: Southwest Research Institute, San Antonio, TX (US)

(72) Inventors: Raphael Gukelberger, Freudenstadt (DE); Garrett L. Anderson, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 59 days.

(21) Appl. No.: 16/010,249

(22) Filed: Jun. 15, 2018

(65) Prior Publication Data

US 2019/0383242 A1 Dec. 19, 2019

(51) Int. Cl.
*F02M 26/04* (2016.01)
*F02M 41/12* (2006.01)
*F02M 57/02* (2006.01)

(52) U.S. Cl.
CPC ..... *F02M 26/04* (2016.02); *F02M 41/128* (2013.01); *F02M 57/023* (2013.01)

(58) Field of Classification Search
CPC ..... F02M 41/128; F02M 41/1416; F02M 45/063; F02M 59/027; F02M 59/102; F02M 26/04
See application file for complete search history.

(56) References Cited

U.S. PATENT DOCUMENTS 3,439,655 A * 4/1969 Pierre ..... F02M 45/063 123/300
5,261,366 A * 11/1993 Regueiro ..... F02D 41/3836 123/299
5,313,924 A * 5/1994 Regueiro ..... F02D 41/3836 123/446
6,230,689 B1 * 5/2001 Tengroth ..... F01N 3/2006 123/508
6,405,709 B1 * 6/2002 Carroll, III ..... F02D 41/3809 123/447
7,552,720 B2 * 6/2009 Borg ..... F02M 59/366 123/506
2002/0096145 A1 * 7/2002 Ricco ..... F02D 41/38 123/446
2002/0117155 A1 * 8/2002 Takeda ..... F02D 1/12 123/509
2010/0083824 A1 * 4/2010 Rastelli ..... F02M 39/02 92/126
2014/0069082 A1 * 3/2014 Alger, II ..... F02B 47/08 60/274
2014/0261322 A1 * 9/2014 Geckler ..... F02D 41/0065 123/445
2014/0331975 A1 * 11/2014 Glugla ..... F02D 41/3845 123/504

(Continued)

*Primary Examiner* — Audrey K Bradley
*Assistant Examiner* — Edward Bushard
(74) *Attorney, Agent, or Firm* — Livingston Law Firm

(57) ABSTRACT

A method of improving fuel delivery in an engine having one or more cylinders that are over-fueled related to other cylinders, such as a D-EGR engine. The fueling system uses a mechanical fuel pump, which is cam-driven. The cam has lobes corresponding to the desired displacement for each cylinder. The lobe corresponding to the over-fueled cylinder is shaped differently, such that the filling stroke of the pump is increased.

17 Claims, 7 Drawing Sheets

(56) References Cited

U.S. PATENT DOCUMENTS

| | | | | |
|---|---|---|---|---|
| 2014/0360461 | A1* | 12/2014 | Ulrey | F02M 26/43 123/299 |
| 2015/0136051 | A1* | 5/2015 | Kunz | F01L 1/04 123/90.15 |
| 2015/0219028 | A1* | 8/2015 | Gingrich | F02M 26/43 123/445 |
| 2015/0226169 | A1* | 8/2015 | Williams | F02M 63/027 123/445 |
| 2015/0300285 | A1* | 10/2015 | Macfarlane | F02D 41/3809 123/294 |
| 2016/0230712 | A1* | 8/2016 | Akinyemi | F02M 26/43 |
| 2016/0333830 | A1* | 11/2016 | Henry | F02M 26/40 |
| 2017/0276125 | A1* | 9/2017 | Ishikura | F02M 59/027 |
| 2017/0342969 | A1* | 11/2017 | Mueller | F04B 9/042 |
| 2018/0223777 | A1* | 8/2018 | Gukelberger | F02M 26/21 |
| 2019/0078522 | A1* | 3/2019 | Tamaskar | F02D 41/0065 |

* cited by examiner

INTERNAL COMBUSTION ENGINE HAVING DEDICATED EGR CYLINDER(S) AND IMPROVED FUEL PUMP SYSTEM

TECHNICAL FIELD OF THE INVENTION

This invention relates to internal combustion engines, and more particularly to such engines having one or more cylinders dedicated to production of recirculated exhaust.

BACKGROUND OF THE INVENTION

In an internal combustion engine system having dedicated EGR (exhaust gas recirculation), one or more cylinders of the engine are segregated and dedicated to operate in a rich combustion mode. Because of the rich combustion, the exhaust gases from the dedicated cylinder(s) have increased levels of hydrogen and carbon monoxide. Rich combustion products such as these are often termed "syngas" or "reformate".

Dedicated EGR engines use the reformate produced by the dedicated cylinder(s) in an exhaust gas recirculation (EGR) system. The hydrogen-rich reformate is ingested into the engine for subsequent combustion by the non-dedicated cylinders and optionally by the dedicated cylinder(s). The reformate is effective in increasing knock resistance and improving dilution tolerance and burn rate. This allows a higher compression ratio to be used with higher rates of EGR and reduced ignition energy, leading to higher efficiency and reduced fuel consumption.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The following description is directed to systems and methods for a vehicle, such as an automobile, having an engine with one or more dedicated EGR (D-EGR) cylinders. A D-EGR cylinder can operate at any equivalence ratio because, when its exhaust is recirculated, that exhaust will never exit the engine before passing through another cylinder operating at an air-fuel ratio for which the vehicle's exhaust aftertreatment system is designed. This allows the D-EGR cylinder to run rich, which produces hydrogen (H2) and carbon monoxide (CO) at levels that enhance combustion flame speeds, combustion, and knock tolerance of all the cylinders.

A feature of the invention is the recognition of further improvements that can be made to the fuel system of an engine having one or more D-EGR cylinders. Typically, D-EGR cylinders do not use a separate fuel system. To operate the D-EGR cylinders rich of stoichiometric while the main cylinders generally operate at a lean or stoichiometric A/F ratio, the pulse width (PW) of the injectors of the D-EGR cylinders are longer than the injectors of the main cylinders. In particular in a split intake manifold D-EGR engine, the D-EGR cylinder(s) can be operated at equivalence ratios greater than 2. This can result in a fuel pressure reduction in the common fuel rail. This in turn can lead to unwanted pressure oscillations in the common fuel rail, leading to unequal amounts of fuel being injected for the following cylinders. The inconsistency in fuel delivery within the different cylinders can lead to cylinder-to-cylinder imbalance, and imprecise fueling in individual cylinders. In consistent common rail pressure can further lead to deteriorated atomization, increased CO, HC, PM, PN, and NOx emissions, poor combustion and engine efficiency, less charge cooling, reduced over-fueling tolerance due to locally very rich and lean pockets causing poor ignitability, and a less than desired D-EGR cylinder fueling rate.

Thus, this description is further directed to an improved fuel system and method to improve the fuel delivery for all cylinders in a D-EGR engine or any other engine that uses a common fuel rail for cylinders with different fuel demands. It should be understood that the improved fueling method and system described herein is useful with any engine having one or more cylinders that are to be "over-fueled", with D-EGR cylinders being an example of a type of "over-fueled" cylinder.

Conventional Dedicated EGR Systems (Prior Art)

Figure 1:
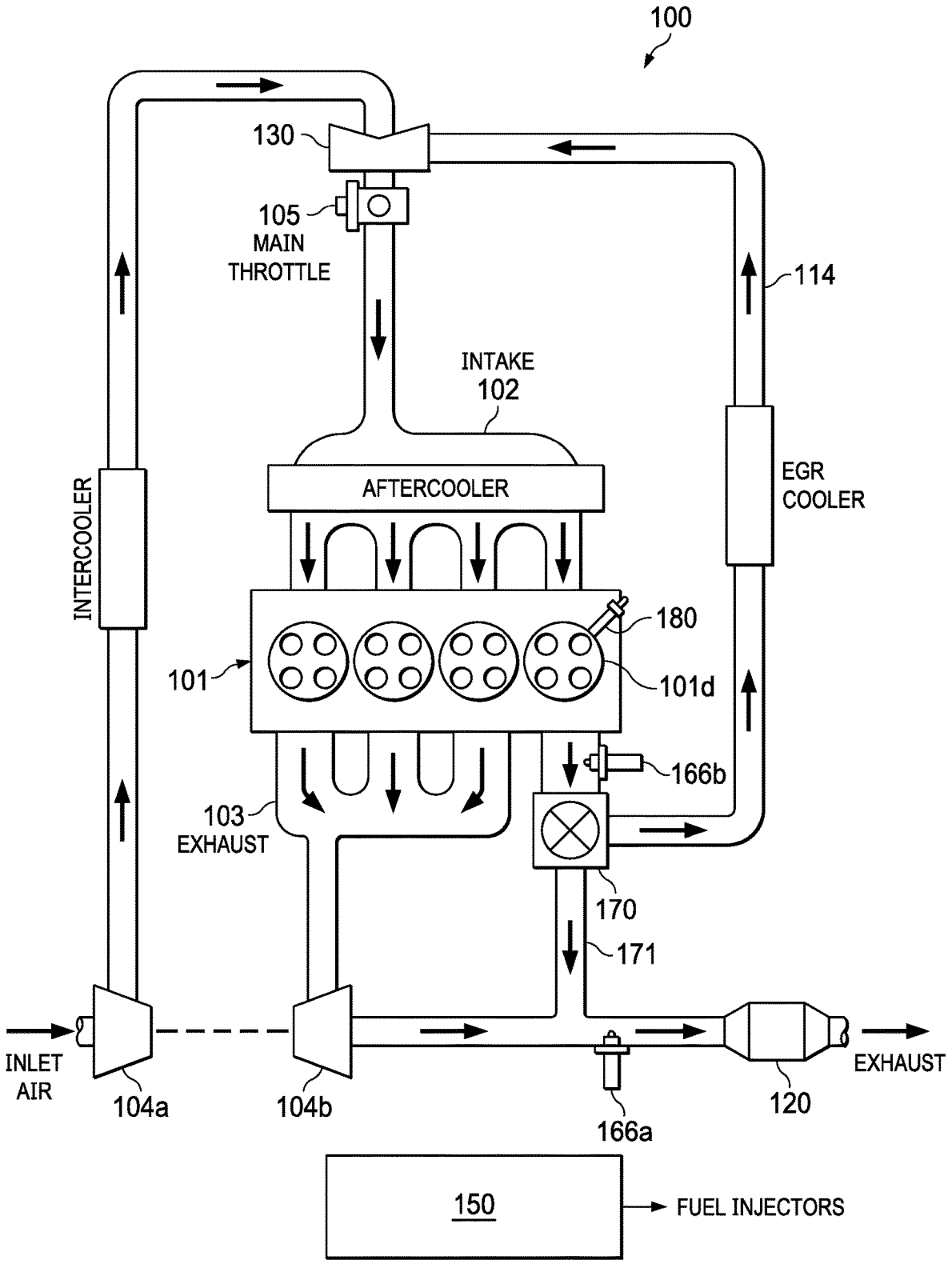
FIG. 1 illustrates a four-cylinder engine with one dedicated EGR cylinder, and a shared intake manifold.

FIG. 1 illustrates an internal combustion engine 100 having four cylinders 101. One of the cylinders is a dedicated EGR cylinder, and is identified as cylinder 101*d*. In the example of FIG. 1, engine 100 is gasoline-fueled and spark-ignited, with each cylinder 101 having an associated spark plug.

The dedicated EGR cylinder 101*d* may be operated at any desired air-fuel ratio. All of its exhaust may be recirculated back to the intake manifold 102.

In the embodiment of FIG. 1, the other three cylinders 101 (referred to herein as the "main" or "non-dedicated" cylinders) are operated at a stoichiometric air-fuel ratio. Their exhaust is directed to an exhaust aftertreatment system via an exhaust manifold 103.

Engine 100 is equipped with a turbocharger, specifically a compressor 104*a* and a turbine 104*b*.

Although not explicitly shown, all cylinders 101 are in fluid communication with a fuel delivery system for introducing fuel into the cylinders. As described below in connection with FIG. 3, the fuel delivery system comprises at least a fuel rail, fuel injectors, and fuel pump. For purposes of this description, the fuel delivery system is assumed to be consistent with gasoline direct injection, and each cylinder 101 is equipped with a fuel injector 180. It is assumed that the fuel injector timing, as well as the amount of fuel injected, for the main cylinders can be controlled independently of the fuel injector timing and fuel amount for the dedicated EGR cylinder(s).

In the example of this description, the EGR loop 114 joins the intake line downstream the compressor 104*a*. A mixer 130 mixes the fresh air intake with the EGR gas. A main throttle 105 is used to control the amount of intake (fresh air and EGR) into the intake manifold 102.

In the embodiment of this description, a three-way valve 170 controls the flow of dedicated EGR to the EGR loop or to the exhaust system. Valve 170 may be used to divert all or some of the EGR from the EGR loop 114 to a bypass line 171 that connects to the exhaust line, downstream the turbine 104*b* and upstream the three-way catalyst 120. Other configurations for controlling EGR flow are possible, such as an EGR valve just upstream of mixer 130.

The four-cylinder dedicated EGR system 100 with a single dedicated cylinder can provide a 25% EGR rate. In other dedicated EGR systems, there may be a different number of engine cylinders 101, and/or there may be more than one dedicated EGR cylinder 101*d*. In general, in a dedicated EGR engine configuration, the exhaust of a subgroup of cylinders can be routed back to the intake of all the cylinders, thereby providing EGR for all cylinders. In some embodiments, the EGR may be routed to only the main cylinders.

After entering the cylinders 101, the fresh-air/EGR mixture is ignited and combusts. After combustion, exhaust gas from each cylinder 101 flows through its exhaust port and into exhaust manifold 103. From the exhaust manifold 103, exhaust gas then flows through turbine 104*b*, which drives compressor 104*a*. After turbine 104*b*, exhaust gas flows out to a main exhaust line 119 to a three-way catalyst 120, to be treated before exiting to the atmosphere.

As stated above, the dedicated EGR cylinder 101*d* can operate at any equivalence ratio because its recirculated exhaust will not exit the engine before passing through a non-dedicated EGR cylinder 101 operating at a stoichiometric air-fuel ratio. Because only stoichiometric exhaust leaves the engine, the exhaust aftertreatment device 120 may be a three-way catalyst.

To control the air-fuel ratio, exhaust gas may be sampled by an exhaust gas oxygen (EGO) sensor. Both the main exhaust line 122 and the EGR loop 114 may have a sensor (identified as 166*a* and 166*b*), particularly because the dedicated EGR cylinder may be operated at a different air-fuel ratio than non-dedicated cylinders. If a dedicated EGR cylinder is run rich of stoichiometric A/F ratio, a significant amount of hydrogen (H2) and carbon monoxide (CO) may be formed. In many engine control strategies, this enhanced EGR is used to increase EGR tolerance by increasing burn rates, increasing the dilution limits of the mixture and reducing quench distances. In addition, the engine may perform better at knock limited conditions, such as improving low speed peak torque results, due to increased EGR tolerance and the knock resistance provided by hydrogen (H2) and carbon monoxide (CO).

An EGR control unit 150 has appropriate hardware (processing and memory devices) and programming for controlling the EGR system. It may be incorporated with a larger more comprehensive control unit. Regardless of division of tasks, it is assumed there is controlling to receive data from any sensors described herein, and perform various EGR control algorithms. Control signals are generated for the various valves and other actuators of the EGR system. Fuel delivery is controlled such that the dedicated EGR cylinder may operate at an equivalence ratio greater than that of the main cylinders.

Figure 2:
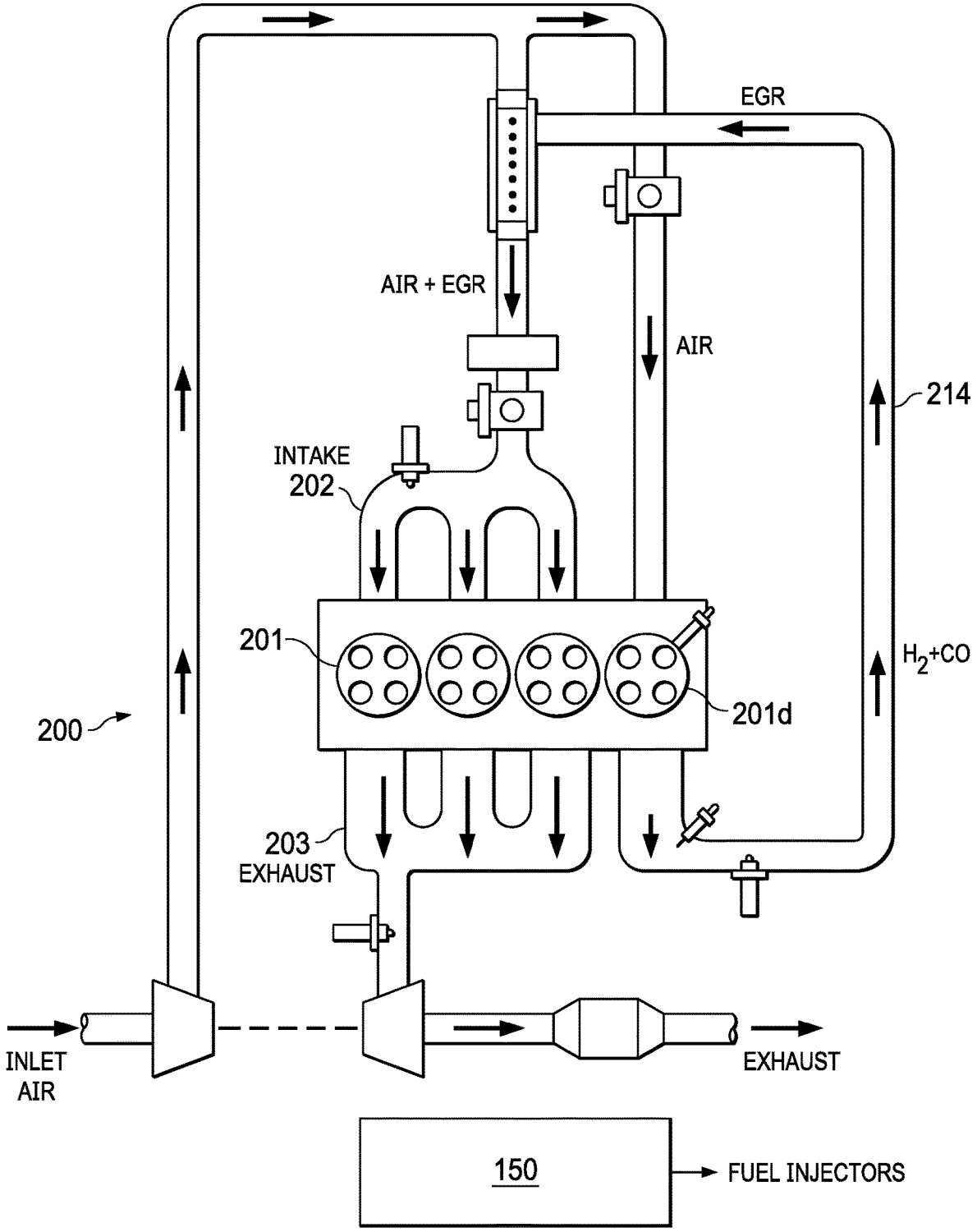
FIG. 2 illustrates a four-cylinder engine with one dedicated EGR cylinder, and a split intake manifold.

FIG. 2 illustrates a "split intake manifold" D-EGR engine 200. As illustrated, the main cylinders 201 share intake manifold 102, which mixes fresh air and EGR from EGR loop 214. Thus, only the main cylinders 201 receive exhaust gas from the D-EGR cylinder 201*d*. The D-EGR cylinder 201*d* does not receive EGR, but rather receives only fresh air.

D-EGR engine 200 does not have bypass valve 170 or bypass line 171, but is otherwise similar in structure and design to D-EGR engine 100.

Figure 3:
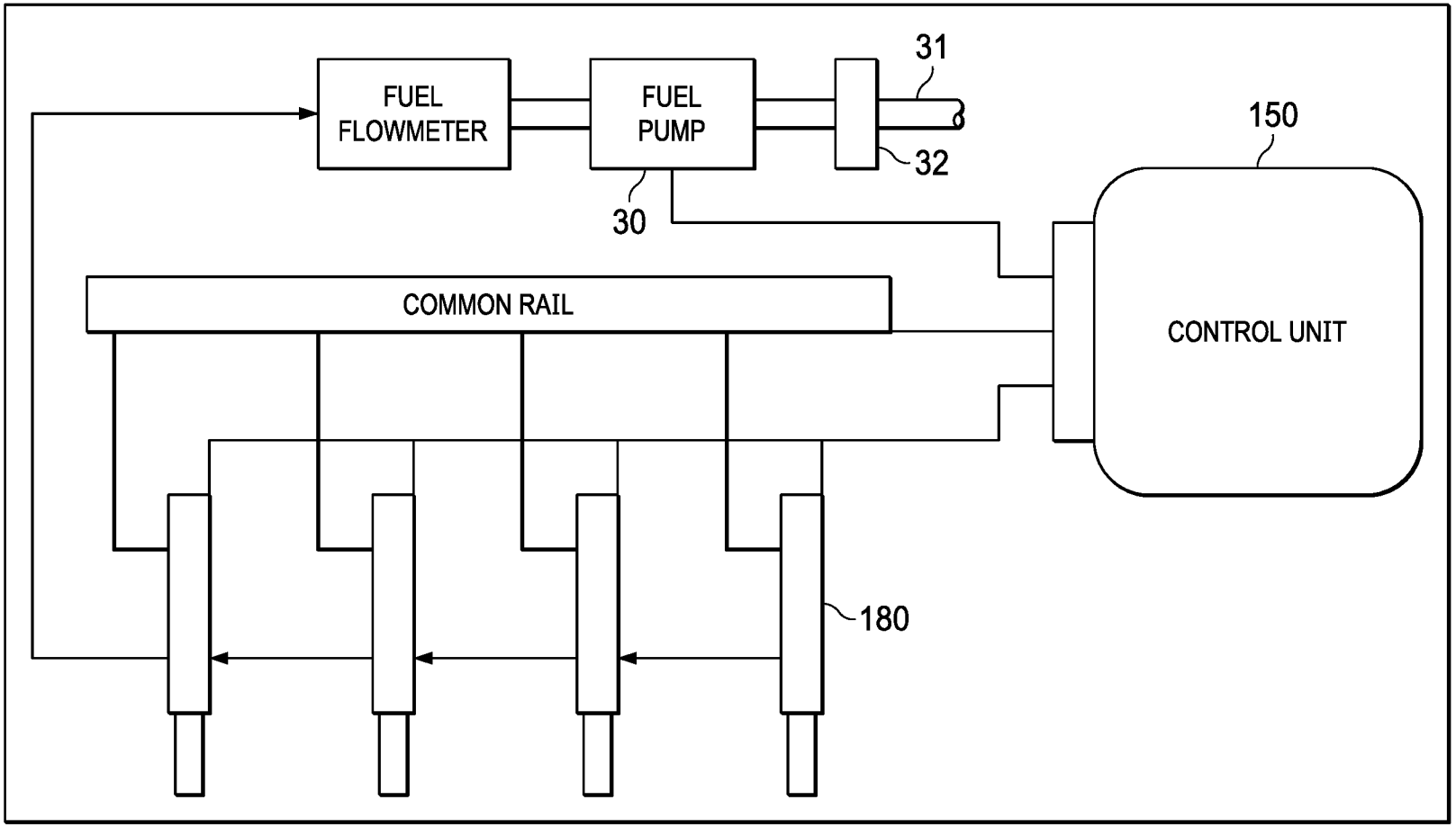
FIG. 3 illustrates a mechanical fuel pump, cam-driven in accordance with the invention.

Fuel Cam Lobe Modifications FIG. 3 illustrates one embodiment of a fuel delivery system suitable for use in engine 100 or engine 200. As stated above, the engine is assumed to be common rail, which means all the injectors 180 are supplied by one pipe carrying high pressure fuel supplied by a fuel pump 30.

In the example of FIG. 3, fuel pump 30 is a cam-driven high pressure plunger fuel pump, but the invention may be used with other cam-driven fuel pump types.

Another specific example is a piston type fuel pump. Fuel pump 30 could also be a diaphragm type pump having a filling stroke driven with a cam. A roller follower fuel pump is another example of a cam-driven fuel pump.

More specifically, fuel pump 30 is a mechanical fuel pump, driven by a camshaft 31 or other shaft driven by the crankshaft. As the camshaft 31 turns, a cam 32 actuates a plunger within fuel pump 30. The displacement of the plunger (or piston or other mechanical device) during the filling stroke determines the amount of fuel that is pumped.

In FIG. 3, cam 32 is shown in side view, but as illustrated below, cam 32 has lobes which determine the timing of the plunger action. In accordance with the invention described herein, cam 32 has a special shape to provide over-fueling once per engine cycle for the D-EGR cylinder 101*d*. increase fuel delivery for every 270 cam degrees.

Fuel is delivered to injectors 180 for injection into the cylinders. An advantage of the invention is that injectors 180 can be direct injectors, and supplied fuel in a range of 40 to 200 bar from high pressure fuel pump 30.

Figure 4:
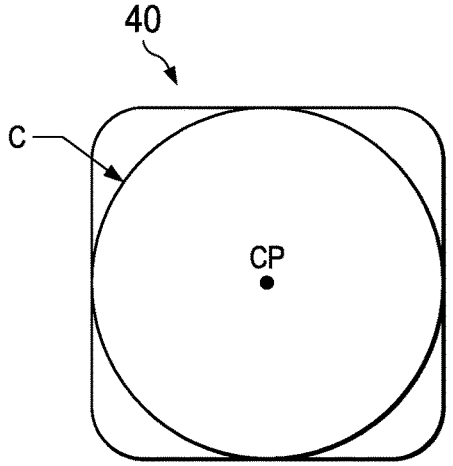
FIG. 4 illustrates a cam for engines having cylinders with the same fueling.

FIG. 4 illustrates the outer profile of a conventional cam 40, which has four equal lobes. The cam drives the fuel pump 30 for each cylinder sequentially, each lobe corresponding to a cylinder. Using cam 40, pump 30 will have the same displacement for each cylinder. An inner circumference, C, and a centerpoint, CP, are illustrated for reference.

Figure 5:
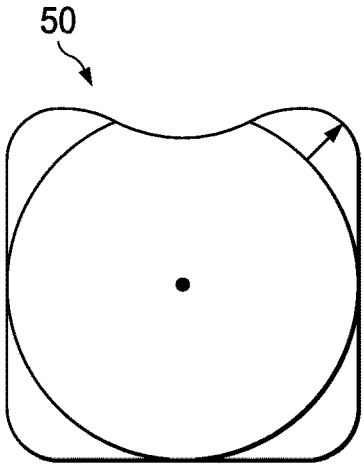
FIGS. 5-7 illustrates various embodiments of cams for engines having an over-fueled cylinder.
Figure 6:
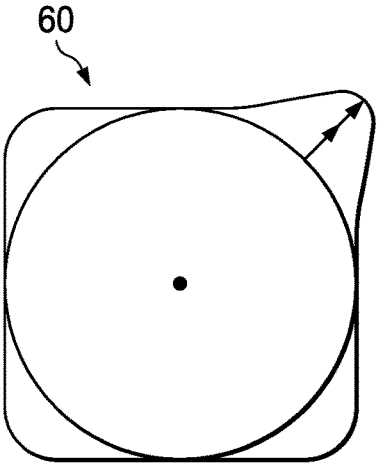

FIGS. 5 and 6 illustrate two embodiments of a cam 50 and 60 in accordance with the invention. The lobes of cams 50 and 60 corresponding to fuel delivery for the D-EGR cylinder(s) are modified. Cams 50 and 60 each increase the fuel delivery for every 360 cam degrees (720 crank degrees) by increasing the filling stroke of the plunger of fuel pump 30. The duration of the filling stroke is equal to that of the convention cam 30. Cam 50 will increase the filling stroke while maintaining the same maximum outer dimension of the cam. Cam 60 will increase the outer dimensions.

The cam 50 of FIG. 5 has an extra concavity on its bearing surface preceding the lobe for D-EGR cylinder 101*d*. The cam 60 of FIG. 6 has a more pronounced (extended) lobe for the D-EGR cylinder 101*d*.

Figure 7:
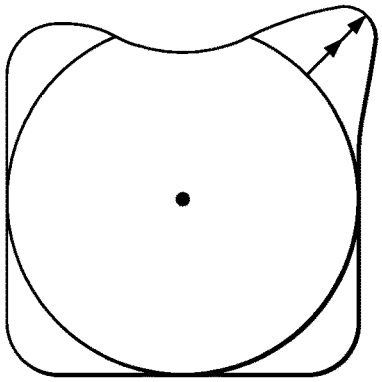

FIG. 7 illustrates a cam 70, which combines the features of cams 50 and 60.

Figure 8:
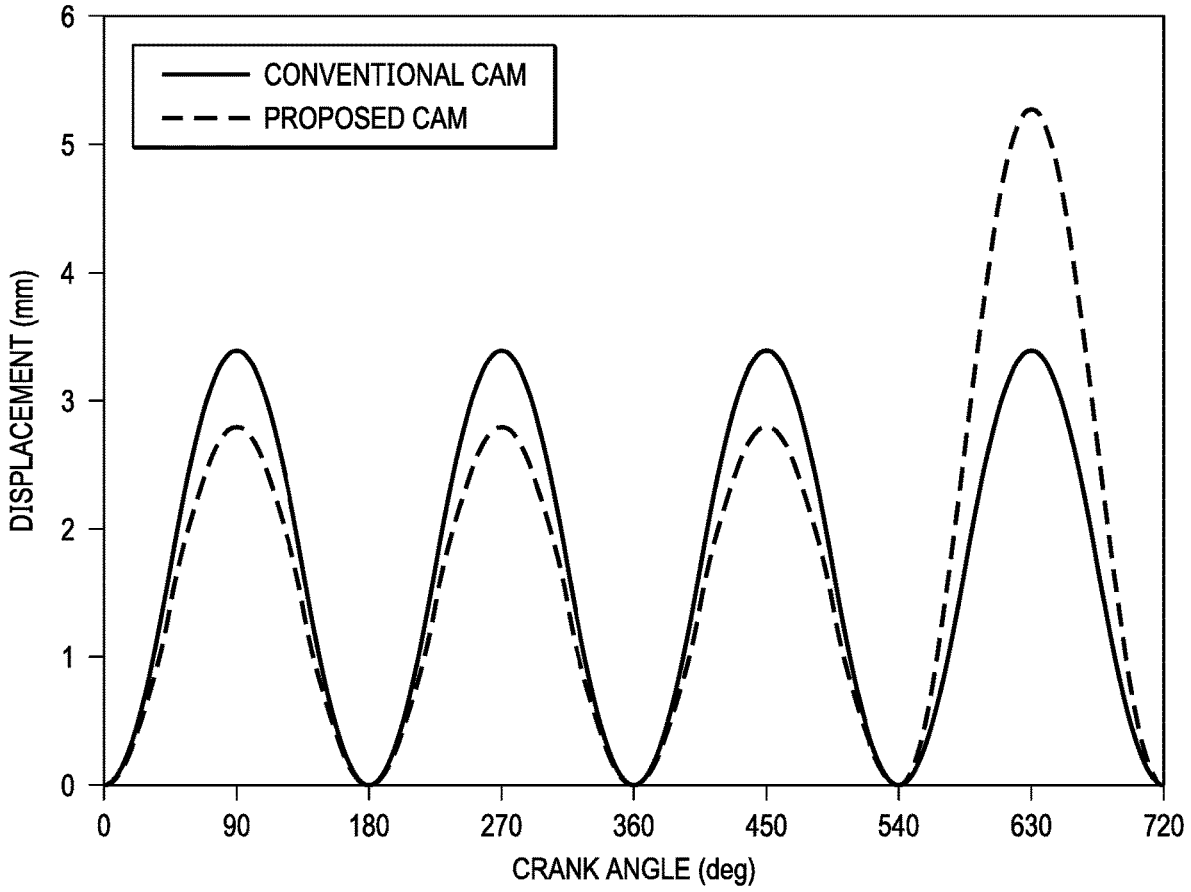
FIG. 8 illustrates an example of the resulting fuel pump displacement profile for the modified cams of FIGS. 5-7.

FIG. 8 illustrates an example of the resulting fuel pump displacement profile for cams 50, 60 or 70. Fuel for the D-EGR cylinder is driven at 540 crank angle degrees. The displacement for the D-EGR cylinder is increased using the modified cam, where "displacement" (mm) is an expression of plunger lift.

Depending on over-fueling requirements and desired flow rates, the fuel pump stroke for the D-EGR cylinder(s) can be increased by more than 100%. To maintain the same overall fuel flow rates, the strokes of the remaining cylinders (main cylinders) can be reduced accordingly to achieve the desired engine output. Otherwise the overall fuel mass flow would increase. The duration of the displacement phases remains constant.

Figure 9:
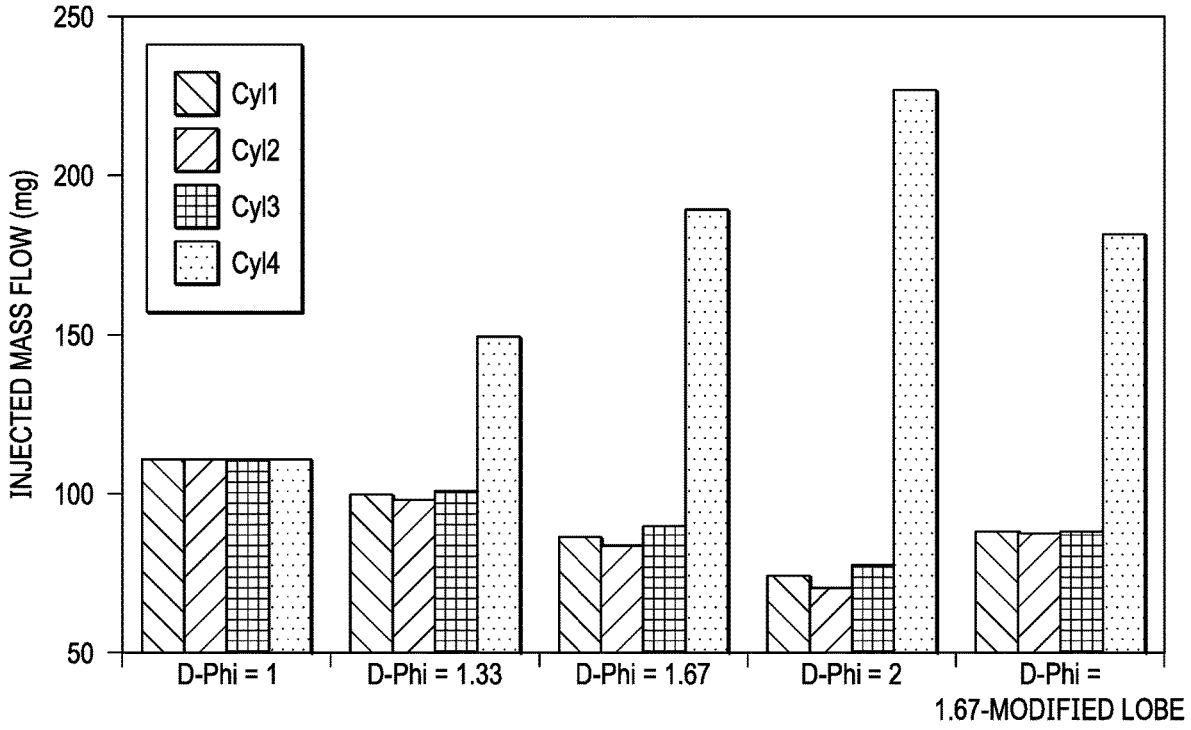
FIG. 9 illustrates an example of individual cylinder injected fuel mass (mg) for different equivalence ratios of the D-EGR cylinder (D-Phi) of a four-cylinder engine, without and with a modified cam.

FIG. 9 illustrates an example of individual cylinder injected fuel mass (mg) for different equivalence ratios of the D-EGR cylinder (D-Phi) of a four-cylinder engine, without and with a modified cam. The D-EGR cylinder is cylinder #4 and the firing order was 1-3-4-2.

The first four different D-Phi's are for an engine having a conventional fuel pump cam, such as shown in FIG. 4. The fifth D-Phi is for an engine having a modified fuel pump cam, such as shown in FIGS. 5-7.

For the stoichiometric operated engine (D-Phi=1), all cylinders have nearly the same injected fuel mass. This results in the least amount of cylinder-to-cylinder variations. However, once the D-EGR cylinder over-fueling rates increase, the fuel quantity discrepancy between the main cylinders also increases. Different fuel quantities lead to unequal torque production, increase combustion instabilities, emissions, NVH, and cause reduced fuel efficiency. The main cylinder that follows the D-EGR cylinder in the firing order (cylinder #2) received up to 10% less fuel than the main cylinders with firing orders before the D-EGR cylinder.

Using the proposed cam design (shown as D-Phi=1.67 modified lobe in FIG. 8), the engine can be run at elevated D-Phi's while minimizing discrepancies in main cylinder fuel quantities.

The results of the modified cam illustrated in FIG. 9 are accomplished without adjusting the control logic of the flow control valve of the fuel pump 30. In addition, other than the modified fuel pump cam, stock fuel components and hardware are used. A D-EGR cylinder specific fuel injector is not required.

Figure 10:
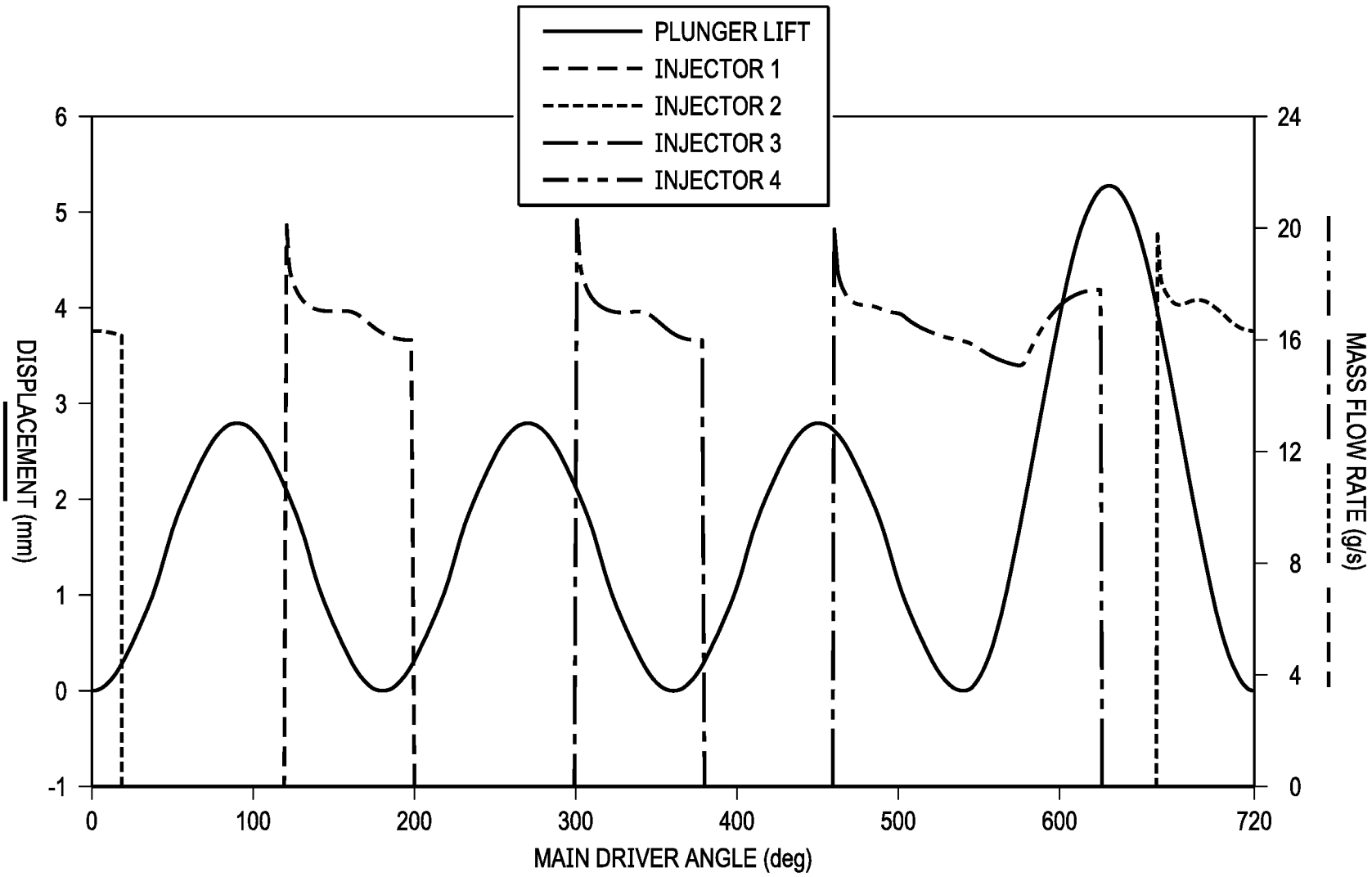
FIG. 10 illustrates an example of fuel pump displacement for a fuel pump having a modified cam (like the illustration of FIG. 8), as well as fuel injection rates for the individual cylinders.

FIG. 10 illustrates fuel pump plunger displacement for cams 50 or 60 or 70 (like the illustration of FIG. 8 and in dashed line), as well as fuel injection rates for the individual cylinders. The fuel injection rates (g/s) are shown for each cylinder, which are fired in the order of FIG. 8, with the D-EGR cylinder having fuel injector #4. The cam lobe modification leads to equally injected mass fuel rates in the main cylinders whereas the D-EGR cylinder has an injector pulse width twice as long. In other words, for a cylinder for whom twice as much fuel is pumped into the rail, its injector will be on twice as long.

For a significantly increased fuel flow of the D-EGR cylinder 101*d* at maximum engine power, the fuel pump 30 will be oversized for the main cylinders 101. For any fuel system, the control system that is actuating the fuel pump 30 will have some degree of error with each pumping event. This is caused by errors in engine synchronization and variability in how the valve closes. Oversizing may result in some increase in error. The effective displacement of the fuel pump 30 is a function of the actual displacement, volumetric efficiency, and error in the control system.

One method to reduce error in the effective displacement is to provide an individual displacement for each cylinder 101. A reduction of the displacement by 30% would translate to a 30% reduction in effective displacement error for the main cylinders 101. This approach could allow for use of existing engine control units and fuel pump hardware while still resulting in more consistent fuel pressure control.

What is claimed is:

1. A method of providing over-fueling for an internal combustion engine, the engine having a number of cylinders, with a subset of the number of cylinders being one or more over-fueled cylinders, comprising:

using a mechanical fuel pump to pump fuel to all of the number of cylinders;

wherein the fuel pump is driven by a camshaft having a lobed cam, such that lobes of the cam result in filling strokes of the fuel pump;

wherein each lobe corresponds to a filling stroke for one of the number of cylinders;

wherein each lobe and/or a surface preceding the lobe that corresponds to one of the subset of the number of cylinders is configured to increase fuel delivery to that one of the subset of the number of cylinders by increasing the filling stroke of the fuel pump;

wherein the same cam controls the amount of fuel delivered to the number of cylinders but results in increased fuel delivered to only the subset of the number of cylinders relative to the remaining of the number of cylinders.

2. The method of claim 1, wherein the surface preceding the lobe that corresponds to the over-fueled cylinder is made more concave than the remaining lobes.

3. The method of claim 1, wherein the lobe that corresponds to the over-fueled cylinder is made more protruding than the remaining lobes.

4. The method of claim 1, wherein the engine has injectors and the fuel pump delivers fuel to the injectors via a common rail.

5. The method of claim 1, wherein the fuel pump is a high pressure fuel pump, delivering fuel in a range of 40 to 200 bar.

6. The method of claim 1, wherein the fuel pump is one of the following types of fuel pumps: piston, plunger, roller follower, or diaphragm.

7. The method of claim 1, wherein the engine is a D-EGR (dedicated exhaust gas recirculation) engine having exhaust gas recirculation (EGR) from at least one dedicated EGR (D-EGR) cylinder whose entire exhaust is routed back to engine intake, and wherein the D-EGR cylinder is the same as the over-fueled cylinder.

8. The method of claim 7, wherein the engine is a D-EGR shared intake manifold engine in which all of the number of cylinders share an intake manifold.

9. The method of claim 1, wherein the filling stroke results in as much as twice the amount of fuel delivered to the over-fueled cylinder relative to the amount of fuel delivered to the remaining cylinders.

10. An improved fueling system for an internal combustion engine, the engine having a number of cylinders, with at least one cylinder of the number of cylinders being an over-fueled cylinder, the engine further having a camshaft, comprising:

an injector provided for each of the number of cylinders cylinder and operable to inject fuel for combustion;

a mechanical fuel pump operable to pump fuel to all of the number of cylinders via a common rail to the injectors;

wherein the fuel pump is driven by the camshaft and a lobed cam, such that lobes of the cam result in filling strokes of the fuel pump;

wherein each lobe corresponds to a filling stroke for one of the number of cylinders;

wherein the lobe and/or a surface preceding the lobe that corresponds to the over-fueled cylinder is configured to increase fuel delivery to the over-fueled cylinder by increasing the filling stroke of the fuel pump wherein the same cam controls the amount of fuel delivered to the number of cylinders but results in increased fuel delivered to only the subset of the number of cylinders relative to the remaining of the number of cylinders.

11. The engine of claim 10, wherein the surface preceding the lobe that corresponds to the over-fueled cylinder is made more concave than the remaining lobes.

12. The engine of claim 10, wherein the lobe that corresponds to the over-fueled cylinder is made more protruding than the remaining lobes.

13. The engine of claim 10, wherein the engine delivers fuel via direct injection injectors.

14. The engine of claim 10, wherein the fuel pump is a high pressure fuel pump, delivering fuel in a range of 40 to 200 bar.

15. The engine of claim 10, wherein the fuel pump is one of the following types of fuel pumps: piston, plunger, roller follower, or diaphragm.

16. The engine of claim 10, wherein the engine is a D-EGR (dedicated exhaust gas recirculation) engine having exhaust gas recirculation (EGR) from at least one dedicated EGR (D-EGR) cylinder whose entire exhaust is routed back to engine intake, and wherein the D-EGR cylinder is the same as the over-fueled cylinder.

17. The engine of claim 16, wherein the engine is a D-EGR shared intake manifold engine in which all of the number of cylinder share an intake manifold.

* * * * *